US005410784A

United States Patent [19]

Katz

[11] Patent Number: 5,410,784

[45] Date of Patent: May 2, 1995

[54] INTERCHANGEABLE CLASP

[76] Inventor: Teresa Katz, 153 W. 93rd St., New York, N.Y. 10025

[21] Appl. No.: 21,164

[22] Filed: Feb. 22, 1993

[51] Int. Cl.[6] ..... A44C 5/14

[52] U.S. Cl. ..... 24/589; 24/702; 24/697.1; 63/1.1

[58] Field of Search ..... 24/702, 653, 644, 589, 24/669, 697.1, 630, 356; 63/1.1, 20, 21

[56] References Cited

U.S. PATENT DOCUMENTS 2,586,758 2/1952 Zerr ..... 63/20
4,648,161 3/1987 Rosen ..... 24/702

FOREIGN PATENT DOCUMENTS 2229180 1/1974 Germany ..... 24/589
713826 8/1954 United Kingdom ..... 24/702
1016636 1/1966 United Kingdom ..... 24/589
1138122 12/1968 United Kingdom ..... 24/589
2245642 1/1992 United Kingdom ..... 63/21

*Primary Examiner*—Edward K. Look
*Assistant Examiner*—James A. Larson
*Attorney, Agent, or Firm*—Lieberman & Nowak

[57] ABSTRACT

An interchangeable clasp is formed from a body having at least one recess, a connector configured to fit within this recess and a member for retaining the connector within the recess. This clasp is aesthetically appealing to the viewer and may be used in numerous applications. Through the use of this interchangeable clasp, jewelry variations can be geometrically multiplied, while reducing the cost to the consumer.

1 Claim, 3 Drawing Sheets

INTERCHANGEABLE CLASP

BACKGROUND OF THE INVENTION

The subject invention relates to an interchangeable clasp which can be used with jewelry, belts, pocketbooks, purses, handbags, satchels and the like. The interchangeable clasp permits a single clasp to be used in multiple applications and is designed to be aesthetically pleasing to the eye while enhancing the overall design of the item to which it is affixed. For example, the clasp may be used at one time to join one or more strings of jewelry, (e.g. one end of a necklace to the other, one end of a bracelet to the other, or necklace to necklace and/or bracelet to bracelet, to change length) and at a subsequent time to secure two ends of a belt. In all cases, the clasp provides decoration, structure and the artistic and economic advantage of being transferable from one item to another. The later advantage becomes obvious when one considers that three chains and three clasps affords nine necklaces, i.e. by mixing and matching. Accordingly, the subject clasp is both ornamental and multifunctional.

Clasps having two receptacle ends for use in securing string jewelry are known. For example, Brogan, U.S. Pat. No. 2,051,591, issued Aug. 18, 1936, teaches a connecting member which uses a pressed up portion to exert biasing tension to hold a ball ended shank in place.

A similar device was described by Reuer, U.S. Pat. No. 2,266,074, issued Dec. 16, 1941, provides a clasp having means for a quickly changing the number and style of strings relative to the clasp. Similar to the Brogan clasp, the Reuer clasp uses a spring fastener to secure the string to the clasp.

Zerr, U.S. Pat. No. 2,586,758, issued Feb. 19, 1952, describes a jewelry chain connector in which a plurality of chains can be interlocked into a single connector. The connectors of Zerr may also utilize a fastening projection to form a brooch.

Another variation on a clasp for holding multiple chains or strings of jewelry is described by Linebery, U.S. Pat. No. 4,486,925, issued Dec. 11, 1984. Linebery's design uses a plurality of connecting members attached to a single clasp. Similarly, the jewelry chainstay of Murphy, U.S. Pat. No. 4,527,316, issued Jul. 9, 1985, can be used for attaching multiple ornamental chains to a single clasp. Other patents dealing with similar subject matter include Viot, et al., U.S. Pat. No. 4,665,595, issued May 19, 1987, Geldwerth, U.S. Pat. No. 3,360,836, issued Jan. 2, 1968, and Garfinkel, U.S. Pat. No. 2,113,786, issued Apr. 12, 1938.

No clasp produced to date has utilized a generally cylindrically shaped connector which fits within a recess having a marginally larger volume and retaining means for keeping the connector in place. The design of this clasp allows the central section to be ornamentally crafted, thus rendering it an improvement over earlier clasps.

SUMMARY OF THE INVENTION

The subject invention provides an interchangeable clasp which comprises a body having at least one recess formed therein, at least one connector, and means for electively retaining the connector within the recess. The recess is elongate in dimension and has an opening to the exterior of the body and the connector is configured to removably fit within the recess when inserted through the opening. Typically the body has from one to four recesses formed therein. Two recesses are preferred for necklaces, bracelets and belts, and three are preferred for brooches.

The connector typically comprises a hollow cylinder which is beveled at one end. Means for retaining the connector within the recess typically comprise a latch which is pivotally mounted to the body. The latch may be pivotable from a first position in which the opening to the exterior of the body is open to a second position in which the opening to the exterior of the body is closed. Preferably, the latch further comprises a pin oriented so that when the latch is in the closed position, the pin traverses the opening to the exterior of the body. Alternatively, means for retaining the connector within the recess comprise a slidably mounted member mounted within a track formed within the body. The slidably mounted member preferably moves from a first position wherein the opening to the exterior of the body is opened to a second position wherein the opening to the exterior of the body is closed and further includes means for biasing the slidably mounted member.

To form a brooch, means for affixing the clasp body to another object are provided. These means typically affix the body to another object by means of a pin attached at one end to the body.

The subject application also provides a method of mounting a stone in an item of jewelry. This entails several steps. The first step is providing an item of jewelry having opening therethrough from the front to the back, the opening having a cross-section generally equal to or marginally larger than the largest cross-section of the stone to be mounted. The second step is providing a flange on the front of the item of jewelry. The flange generally conforms to the shape of the opening at the front of the item of jewelry for proportionally reducing the cross-section of the opening. The third step is inserting the stone into the opening from the back of the item of jewelry, so as to contact the stone and the flange. The fourth step is inserting a washer having a cross-section generally equal to or marginally smaller than the cross-section of the opening into the opening from the back of the item of jewelry, so as to sandwich the stone between the flange and the washer. The fifth step is securing the washer within the opening, thereby mounting the stone.

DETAILED DESCRIPTION OF THE INVENTION

Figure 1:
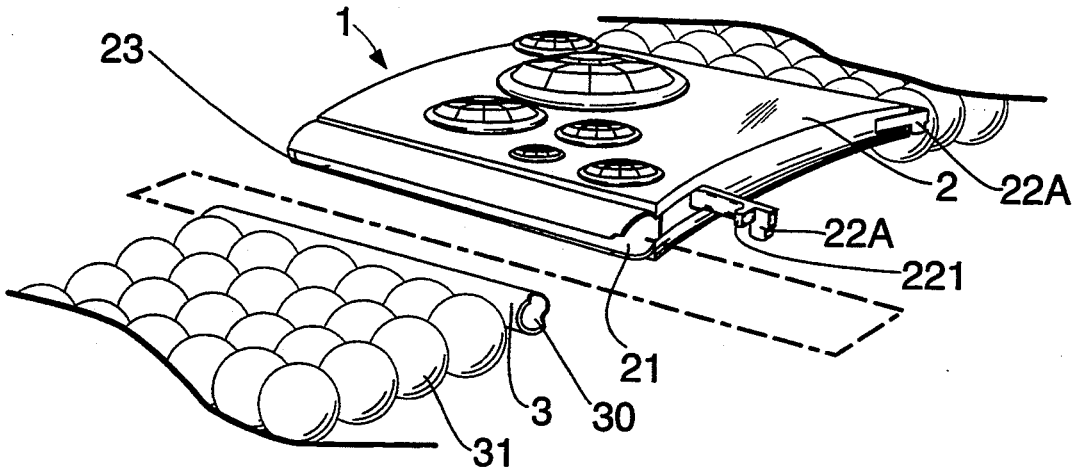
FIG. 1 is a perspective view of the first embodiment of the subject invention.

The following description is of the preferred embodiments of the subject invention. These embodiments are set forth to provide a better understanding of the subject invention, but are not to be construed as limiting.

The subject invention relates to an interchangeable clasp 1 which can be used with jewelry (necklace, bracelets, pendants, pins, etc.), belts, pocketbooks, purses, handbags, satchels and the like. Typically, this clasp is decorative in nature and may be adorned in any manner known to those skilled in the art.

The choice of material from which the clasp can be crafted will vary based on aesthetics and on the materials to which the clasp is to be affixed. By way of example, clasp 1 when used with costume jewelry may be crafted from any suitable base metal which could be shined, burnished or electroplated to provide a decorative look. Similarly, for elegant estate jewelry, clasp 1 could be made from a precious metal such as platinum, gold or silver and may be adorned with one or more stones 4. Of course clasp 1 could be formed from any suitably rigid material, such as a polymeric resin, plastic, graphite, metal, wood, stone, bone, shell or the like.

In the embodiment illustrated in the figures, stones 4 have been mounted in body 2 of clasp 1. Turning to FIG. 7, stones 4 are shown mounted within a hole in body 2 and are retained by a flange 41 (see FIG. 2 for a top side view) having a slightly smaller diameter opening than the maximum diameter of the stone to be retained. The term diameter is used for round stones 4. For other stones 4, the largest cross-section of the stone corresponds with the cross-section of the hole through the item of jewelry. For example, if the stone was triangular, the hole would be a vacuous triangular prism, etc. On the reverse side of base 2, a washer 42 (shown in outline in FIG. 6) having an inner diameter slightly smaller than the maximum diameter of stone 4 and an outer diameter approximately equal to that of the opening in body 2 is affixed in place to secure stone 4. Washer 42 may be held in place by any known means, but is typically restrained by soldering or compression fit. Other means of decoration are within the skill of the artisan. Since jewelry is an ancient and well developed art, the selection of materials, sizes, compositions, ornamental patterns, etc. are obvious, and accordingly will not be discussed in detail.

Referring to the figures, clasp 1 comprises body 2 and connector 3. Connector 3 is configured generally as cylinder so as to slidably fit within recess 21 in body 2. The term "cylinder" as used in the subject application is to mean any elongated three dimensional shape. Examples of such shapes include, but are not limited to, triangular prisms, quadrilateral prisms, pentagonal prisms, hexagonal prisms, cones, fustrums, ovaloids, etc. Often times these shapes will be hollow, both for economy and to allow insertation of retaining pin 221.

Recess 21 is configured so that connector 3 can slidably fit therein. Preferably, the fit between connector 3 and recess 21 is such that relative movement between the parts is minimized when the parts are engaged. Connector 3 is typically a hollow cylinder and recess 21 is a cylindrical chasm into which connector 3 is slidably inserted. Preferably, connector 3 has an exterior volume substantially identical to or slightly smaller than the interior volume of the corresponding cylindrical chasm (recess 21) so that connector 3 snugly fits within recess 21.

Means are provided for retaining connector 3 within recess 21. These means may include friction between connector 3 and recess 21, i.e. a tight fit, or may use a pivotally mounted latch 22A or a slidable latch 22B, among other means known to those skilled in the art. Other embodiments and means are also determinable by one skilled in the art.

Figure 2:
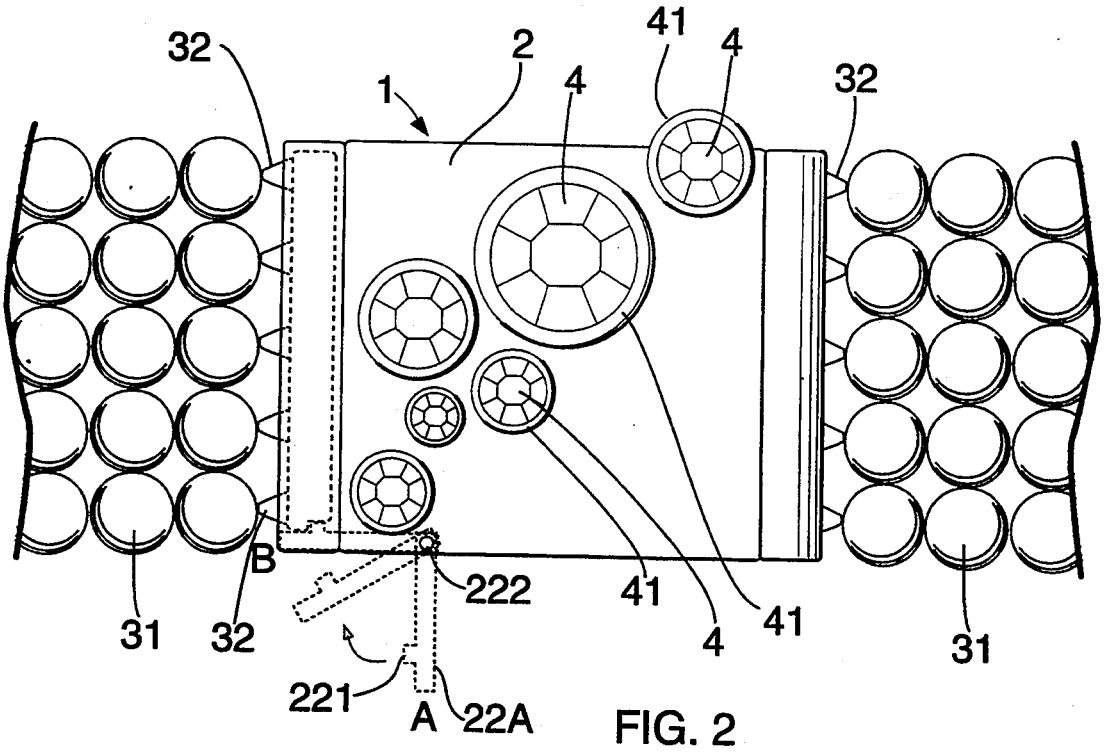
FIG. 2 is a top view of the first embodiment of the subject invention.
Figure 3:
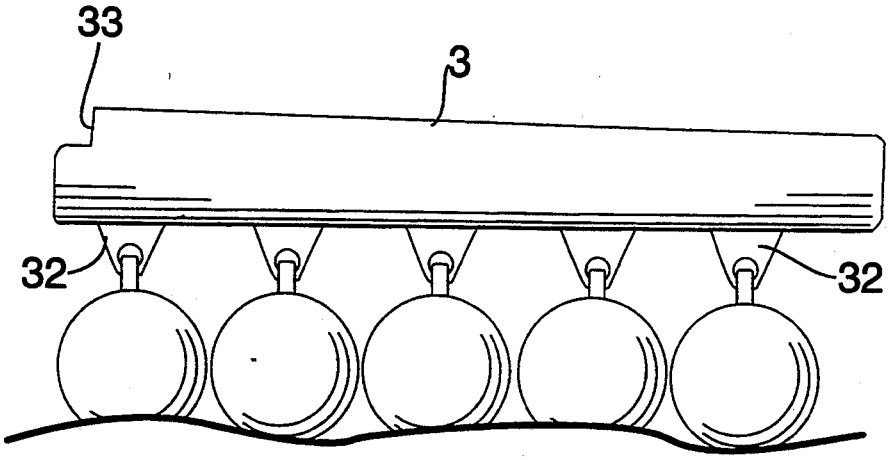
FIG. 3 is a top plan view of the connector portion of the subject clasp.

Latch 22 may be used to retain connector 3 within recess 21. As is shown in FIG. 2, latch 22A moves from an open position in which connector 3 can be freely moved in and out of recess 21 to a closed position (via the direction of the arrow) in which latch 22A contacts and retains connector 3 within recess 21. Preferably, in this position pin 221 enters void 30 of connector 3. As detailed in FIG. 3, a portion of connector 3 may be removed (beveled) so that pin 221 can freely enter void 30.

Figure 4:
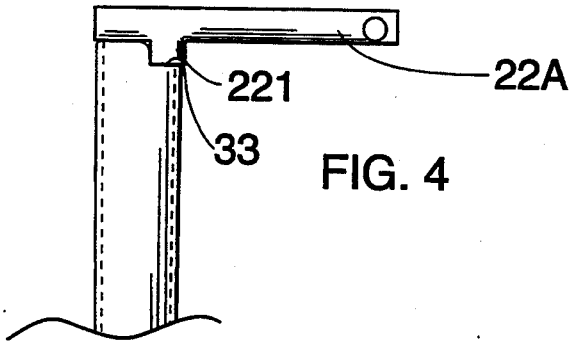
FIG. 4 is a plan view of an isolated connector portion engaged with a latch.

FIG. 4 shows the preferred engagement of pin 221 and connector 3. As shown, pin 231 rests in closed position B, on beveled edge 33 to hold connector 3 in place. By providing an amount of friction between latch 22 and body 2, latch 22 is held in place.

In the figures, slit 23 is shown as transversing the entire length of recess 21. Slit 23 allows connector 3 to be affixed to attachment 32 which can link connector 3 with length 31 (see below). Such a configuration is needed when attachment 32 substantially runs entire length of connector 3. If clasp 1 is used solely for a single string of pearls or single chain, slit 23 may run substantially less than the length of recess 21.

Figure 5:
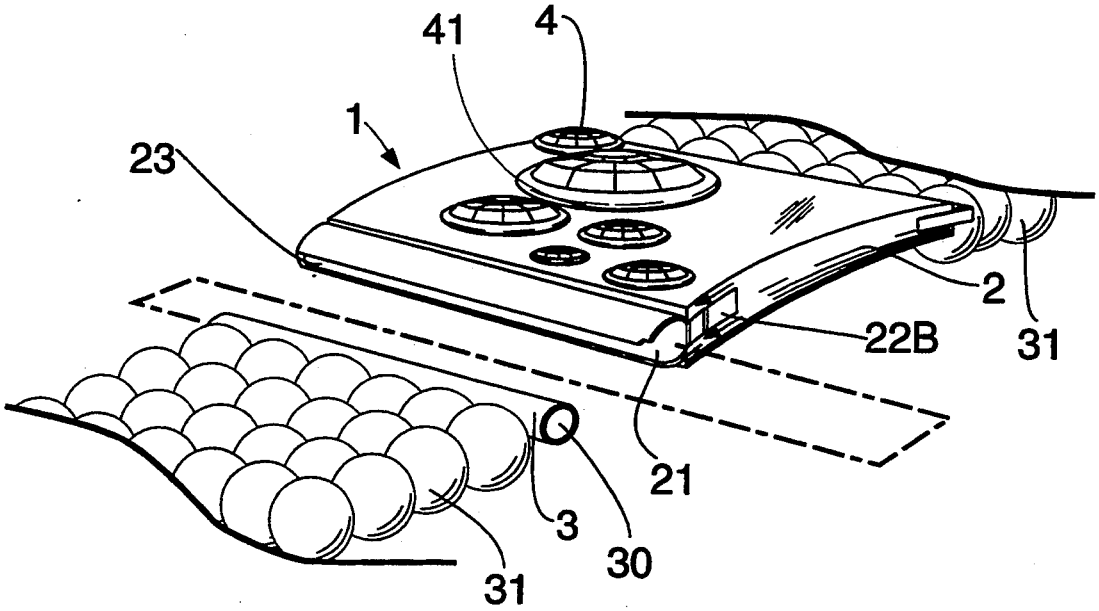
FIG. 5 is a perspective view of the second embodiment of the subject invention.

FIG. 5 shows a second embodiment of the subject invention wherein latch 22A is replaced by sliding member 22B. Sliding member 22B runs within a track in body 2. Sliding member 22B moves from a first open position in which connector 3 can readily be moved in and out of recess 21 to a closed position in which the opening to recess 21 is occluded. When sliding member 22B occludes recess 21, removal of connector 3 from recess 21 is prevented. Sliding member 22 typically includes some type of biasing means to prevent it from sliding between the closed and the open position. Such a biasing means may include a simple bump and crevice, i.e. a bump on sliding member 22B and a crevice on body 2, or conversely a bump on body 2 and a crevice on sliding member 22B. Other possible biasing means include, but are not limited to, a flat spring or coil spring mounted within body 2.

FIG. 2 shows an embodiment of the subject invention having two recesses 21 located on opposing sides of body 2. This configuration is especially suitable for conventional necklaces, bracelets and belts. As shown in FIG. 2, connector 3 may be coupled with a strap, string of beads or the like, chain, etc. (generically referred to herein as length 31). As depicted in the figures, multiple lengths 31 may be connected to a single connector 3. Length 31 is typically attached to connector 3 via one or more attachments 32. Attachments 32 disrupt the generally cylindrical shape of connector 3. Since body 2 must be configured to allow connector 3 to be inserted within recess 21, slit 23 is typically provided.

Figure 6:
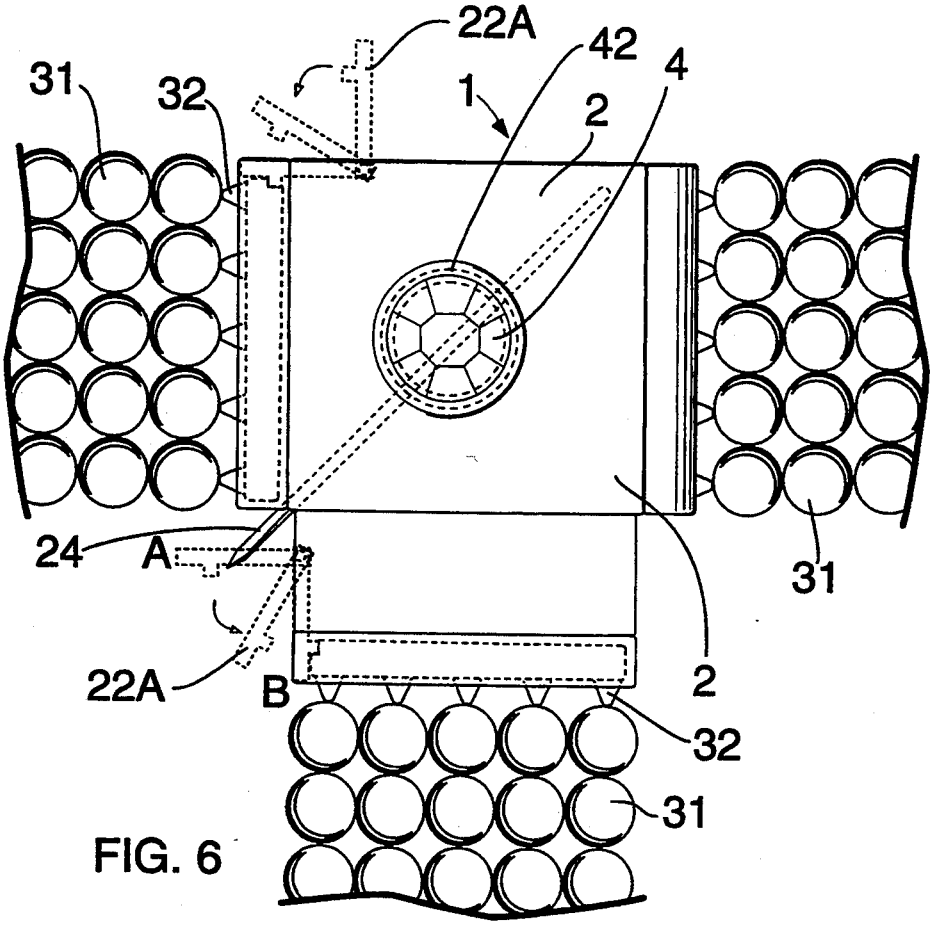
FIG. 6 is a top view of the third embodiment of the subject invention.
Figure 7:
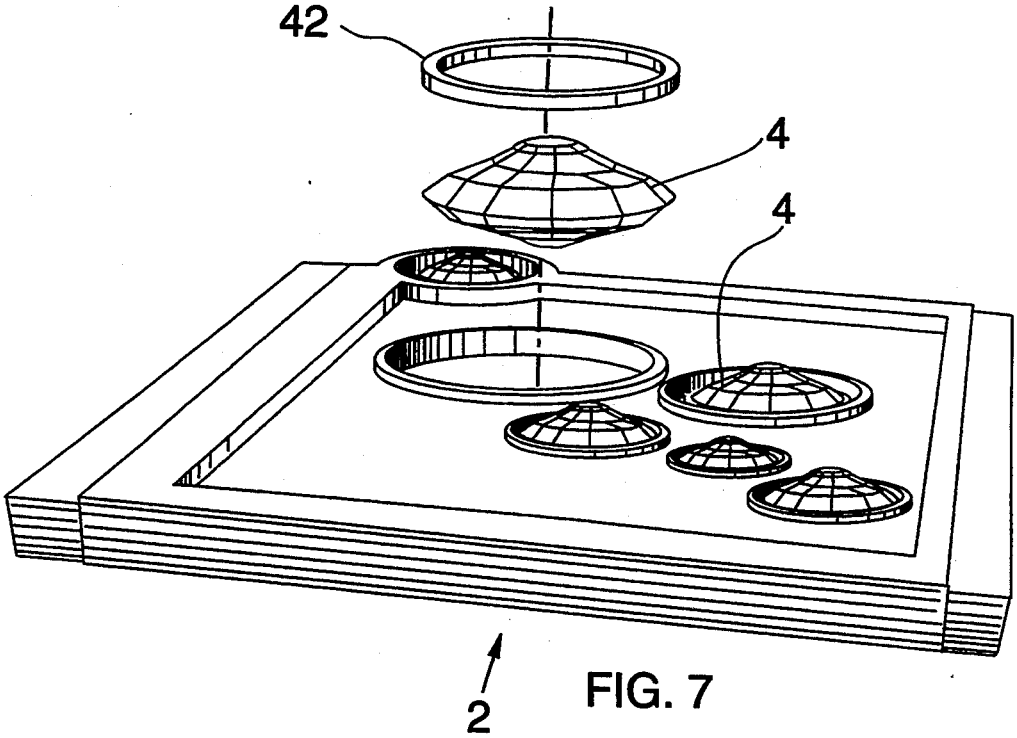
FIG. 7 is a perspective view of the back of the clasp illustrating the described method of mounting a stone.

Referring to FIG. 6, an embodiment is shown wherein body 2 has three recesses 21 into which three corresponding connectors 3 may be engaged. As shown, means for affixing clasp 1 to an object (shirt, blouse, skirt, satchel, etc.) may be included on body 2 so as to form a brooch. In FIG. 6, means are depicted as straight pin 24 having one end secured at body 2 and the other end free to traverse a material so as to secure clasp 1 to the material. Any means for connection fall within the scope of the subject invention. For example, means may include snaps, buttons, clamps, hook and loop fastening means (such as VELCRO), hooks, magnets, combs (for wearing clasp 1 in one's hair), etc. Although not depicted, body 2 may include any number of recesses 21 into which connector 3 may be inserted. For necklace applications, this number is typically two (see FIG. 2). For brooch applications, this number will typically be from one to four (see FIG. 6).

Recesses 21 not utilized to secure lengths 31 may be used for securing connectors 3 having decorative features annexed thereto. For example, connector 3 may be mounted to a simple geometric or other shape which would have no additional connector 3 affixed. As another example, body 2 could have four recesses 21. A head could be mounted to first connector 3, two wings mounted to second and third connector 3, and a tail mounted to fourth connector 3, so as to form a bird-like brooch.

Upon reading the subject application, numerous variations and alternative embodiments will become obvious to those skilled in the art. These alternative embodiments are to be considered within the scope and spirit of the subject invention. The subject invention is only to be limited by the claims which follow and their equivalents.

What is claimed is:

1. An interchangeable clasp which comprises:

a body having at least one recess formed therein, the recess being elongated in dimension and having an opening to the exterior of the body;

at least one connector, the connector being configured to removably fit within the recess when inserted through the opening; and a slidably mounted member mounted within a track formed within the body for electively retaining the connector within the recess the slidably mounted member moving from a first position wherein the opening to the exterior of the body is open to a second position wherein the opening to the exterior of the body is closed;

and means for biasing the slidably mounted member.

* * * * *